United States Patent [19]

Klassen

[11] Patent Number: 4,869,222

[45] Date of Patent: Sep. 26, 1989

[54] CONTROL SYSTEM AND METHOD FOR CONTROLLING ACTUAL FUEL DELIVERED BY INDIVIDUAL FUEL INJECTORS

[75] Inventor: David J. Klassen, Dearborn, Mich.

[73] Assignee: Ford Motor Company, Dearborn, Mich.

[21] Appl. No.: 219,128

[22] Filed: Jul. 15, 1988

[51] Int. Cl.[4] ..... F02D 41/14; F02D 41/18

[52] U.S. Cl. ..... 123/489; 123/486; 123/494; 364/431.05

[58] Field of Search ..... 123/440, 478, 480, 486, 123/489, 494; 364/431.05, 510

[56] References Cited

U.S. PATENT DOCUMENTS

| | | | |
|---|---|---|---|
| 4,111,171 | 9/1978 | Aono et al. | 123/489 X |
| 4,116,169 | 9/1978 | Krupp et al. | 123/486 |
| 4,301,780 | 11/1981 | Hoshi | 123/486 |
| 4,483,300 | 11/1984 | Hosaka et al. | 123/489 |
| 4,517,947 | 5/1985 | Nishikawa et al. | 123/489 |
| 4,517,949 | 5/1985 | Ito et al. | 123/489 |
| 4,602,601 | 7/1986 | Kanai | 123/489 X |
| 4,627,402 | 12/1986 | Saito et al. | 123/489 X |
| 4,694,805 | 9/1987 | Yatabe et al. | 123/489 |
| 4,694,809 | 9/1987 | Nakano et al. | 123/489 |
| 4,766,870 | 8/1988 | Nakajima et al. | 123/440 X |

*Primary Examiner*—Willis R. Wolfe

*Attorney, Agent, or Firm*—Allan J. Lippa; Peter Abolins

[57] ABSTRACT

A fuel injection control system coupled to a multiport fuel injected engine for adjusting the air/fuel mixture of each combustion chamber to a preselected level. A plurality of fuel command controllers provides a separate fuel command signal to each fuel injector in response to a single base fuel command. During each correction interval of a correction time period, each of the fuel command signals is perturbed or offset in a predetermined sequence by a predetermined amount. A measurement of the average of air/fuel ratios among the combustion chambers is taken each correction interval. Airflow inducted into the combustion chambers is also measured. In response to these measurements, and the known fuel offsets, the actual fuel delivered by each fuel injector is calculated. All the fuel command controllers are corrected in response to associated fuel calculations to balance the air/fuel ratios of each combustion chamber.

13 Claims, 2 Drawing Sheets

CONTROL SYSTEM AND METHOD FOR CONTROLLING ACTUAL FUEL DELIVERED BY INDIVIDUAL FUEL INJECTORS

BACKGROUND

The invention generally relates to controlling the actual fuel delivered to individual combustion chambers and, more particularly, the individual control of combustion chamber air/fuel ratios.

Feedback control systems are known for controlling the average air/fuel ratio of the engine in response to a single oxygen sensor coupled to the engine exhaust manifold. More specifically, open loop control is first established by simultaneously varying the pulse width of all fuel injector drive signals the same amount in relation to a measurement of airflow inducted into the engine. Feedback control is then established by further adjusting all the drive signals simultaneously by the same amount in response to the exhaust gas oxygen sensor thereby achieving a desired average air/fuel ratio. A problem with this approach is that the air/fuel ratio is an average of the individual air/fuel ratios of each combustion chamber. A variation in air/fuel ratios among the combustion chambers is most likely For example, each fuel injector may actually deliver a different quantity of fuel when actuated by the identical drive signal due to such factors as manufacturing tolerances, component wear, and clogging. Even though known feedback control systems may achieve the desired average air/fuel ratio, the variations in air/fuel ratios among combustion chambers may result in less than optimal power, driveability, and emission control.

An approach to controlling air/fuel ratios of the individual combustion chambers is disclosed in U.S. Pat. No. 4,483,300 issued to Hosaka et al. In simplified terms, fluctuations in the exhaust gas sensor signal are examined to detect cylinder to cylinder distribution of the air/fuel ratio. A disadvantage of this approach is that a very fast exhaust gas oxygen sensor is required to detect variations in the exhaust output of each cylinder. A further disadvantage is that because exhaust output of each cylinder is mixed in an exhaust manifold, the signal to noise ratio with respect to each cylinder is very low requiring complex signal processing techniques. Another disadvantage of this approach is the complexity of the computations and microprocessor capability required. Since a typical engine microprocessor must control numerous engine functions, the memory available for storing additional program codes is severely limited. Accordingly, the approach disclosed by Hosaka et al may not be suitable for a large number of automobile applications.

SUMMARY OF THE INVENTION

It is an object of the invention described herein to provide a control system for controlling air/fuel ratios of individual combustion chambers with a high degree of accuracy, minimal computational steps, and utilization of conventional engine sensors.

In one aspect of the invention the above problems and disadvantages are overcome, and object achieved, by providing a fuel injection control method for correcting variations in fuel delivered among a plurality of fuel injectors each being coupled to an engine combustion chamber. More specifically, this method comprises the steps of: generating a separate fuel command signal for each of the fuel injectors such that fuel delivered by each of the injectors is proportional the fuel command signal coupled to the respective fuel injector; offsetting each of the fuel command signals in a predetermined sequence during a correction time period; measuring airflow inducted into the combustion chambers during the correction time period; providing a measurement of average air/fuel ratio among the combustion chambers during the correction period; calculating the actual fuel charge delivered by each of the fuel injectors during the correction time period in response to the amount of the offset and the measurement of air/fuel ratio and the measurement of inducted airflow; and correcting the fuel command signals in response to the calculation of actual fuel charge such that each of the fuel injectors delivers substantially the same amount of fuel in response to the fuel command signal.

An advantage is obtained of requiring only an average measurement of air fuel ratios among the combustion chambers. Thus a calculation of actual fuel delivered by each fuel injector is obtained without the need for sophisticated exhaust gas oxygen sensors that, supposedly, measure the air/fuel distribution of each individual combustion chamber. Further, utilization of an average exhaust gas oxygen measurement results in improved signal to noise performance and simpler computational steps than heretofore possible.

In another aspect of the invention, a fuel injection control system is provided coupled to a multiport fuel injected engine for adjusting the air/fuel mixture of each combustion chamber to a preselected level. More specifically, the fuel injection control system comprises: a plurality of fuel injectors, each responsive to a separate fuel command signal and each coupled to one of the combustion chambers; airflow means providing an airflow signal related to airflow inducted into the engine; signal generating means responsive to the airflow signal for generating the plurality of fuel command signals; offset means for individually offsetting each of the fuel command signals in a predetermined sequence by a predetermined amount during a correction time period; an air/fuel sensor providing and air/fuel ratio signal indicative of an average air/fuel ratio among the combustion chambers; calculation means responsive to the offset means and the air/fuel ratio signal and the airflow signal for calculating the actual fuel charge delivered by each of the fuel injectors during the correction time period; and update means responsive to the calculating means for updating the signal generating means during the correction time period to maintain the preselected air/fuel ratio in each of the combustion chambers.

Preferably, the correction time period comprises a number of correction intervals equal to the number of combustion chambers. The calculating means, preferably, multiplies the airflow signal times an inverse of the air/fuel ratio signal to generate a fuel value for each of n equations. The fuel charge is equal to the corresponding offset times the respective unknown fuel delivered by each of the fuel injectors. A separate equation is generated for each of n correction intervals. An additional advantage obtained is that simple linear algebra is used to solve n equations having n unknowns (fuel charge for each fuel injector). Thus, the computational complexity of prior approaches is eliminated.

BRIEF DESCRIPTION OF THE DRAWINGS

The objects and advantages described herein will be more fully understood by reading the Description of the Preferred Embodiment with reference to the drawings wherein.

DESCRIPTION OF THE PREFERRED EMBODIMENT

Figure 1A:
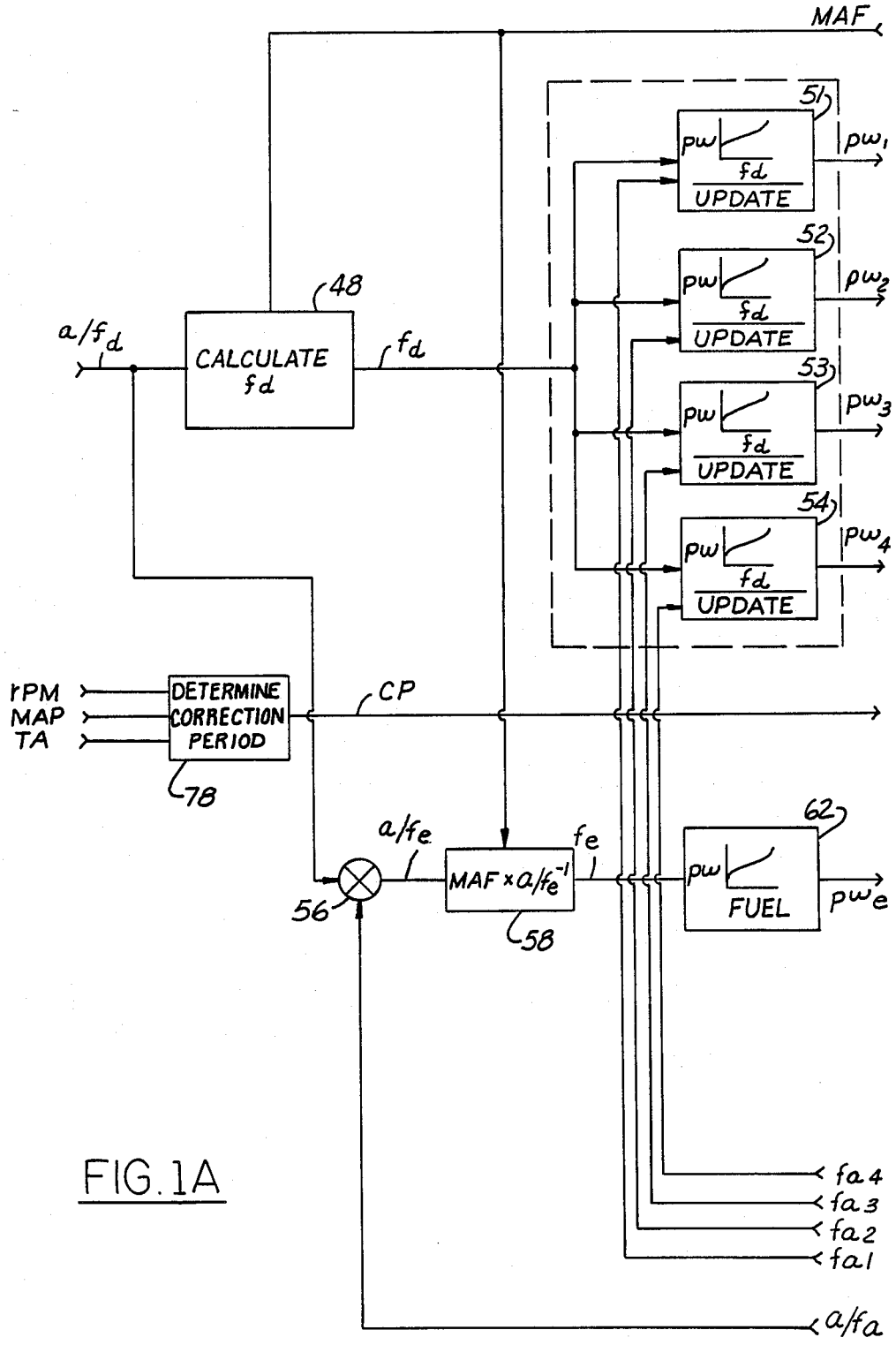
FIGS. 1A and 1B taken together show a single block diagram of an embodiment wherein the invention is used to advantage.
Figure 1B:
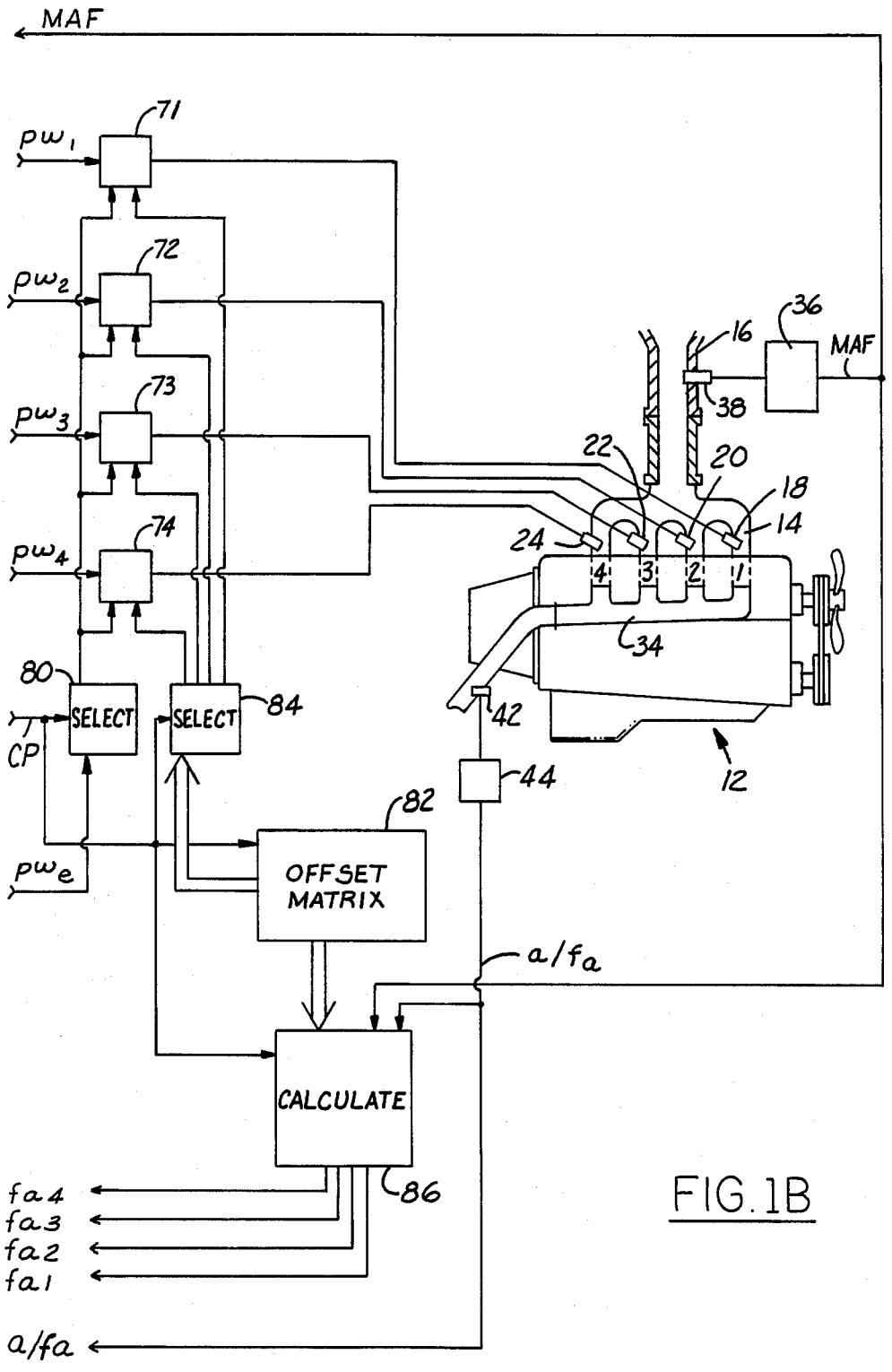

An example of an embodiment in which the invention is used to advantage is presented with reference to FIGS. 1A and 1B. The example is first described in general terms and later herein is described in more detail. It is to be understood that the numerically labeled blocks shown in FIG. 1 may be representative of computational steps performed by a microcomputer, or they may be representative of discrete components performing the functions described hereinbelow.

Referring to FIG. 1, internal combustion engine 12 is shown in this example as a four cylinder gasoline fuel engine with multiple fuel injectors. Intake manifold 14 is shown coupled between air intake 16 and combustion chambers 1, 2, 3 and 4. Fuel injectors 18, 20, 22 and 24 are coupled to intake manifold 14 in proximity to each of respective combustion chambers 1, 2, 3 and 4. Fuel is supplied by fuel injectors 18, 20, 22 and 24 in proportion to the pulse width of respective fuel command signals $pw_1$, $pw_2$, $pw_3$, and $pw_4$. Exhaust manifold 34, a single exhaust manifold in this example, is shown coupled to combustion chambers 1, 2, 3 and 4 for common collection of exhaust emissions from each of the combustion chambers. In a conventional manner, air inducted through air intake 16 is mixed with injected fuel from the respective fuel injector located in proximity to a respective combustion chamber. Exhaust gases from each combustion chamber are forced through exhaust manifold 34 and past a conventional catalytic converter (not shown).

An airflow signal (MAF) proportional to the mass airflow inducted through air intake 16 is generated by airflow meter 36 which includes airflow sensor 38, a conventionally heated wire in this example. Those skilled in the art will recognize that there are other conventional sensors and associated circuits for generating an airflow signal. For example, an airflow signal may be generated from throttle angle or from a manifold pressure measurement by means of a conventional speed density algorithm. It is also noted that the invention described herein may also be used to advantage with other types of fuel injected engines such as, for example, direct fuel injection.

Exhaust gas oxygen sensor 42, in this example a proportional exhaust gas oxygen sensor, is shown coupled to exhaust manifold 34. Air/fuel ratio circuit 44 is here shown coupled to exhaust gas oxygen sensor 42 for providing an air/fuel signal ($a/f_a$) proportional to an average of the individual air/fuel ratios among the combustion chambers. Although a proportional exhaust gas oxygen sensor is used in this example, it will be apparent that with appropriate modification other forms of exhaust gas oxygen sensors may be used to advantage, such as, for example, a "two-state" (rich or lean) exhaust gas oxygen sensor.

A desired or selected air/fuel ratio ($a/f_d$) for overall engine operation is shown coupled to desired fuel charge calculation block 48. Typically, $a/f_d$ is selected for operation at stoichiometry (14.7 lbs. air/1 lb. fuel) such that engine emissions are within he operating window of a conventional catalytic converter. It is to be noted that other air/fuel ratios may be selected. For example, with lean burn engines, it is desirable to operate near the lean burn limit (air/fuel ratios between 18 lbs. air/1 lb. fuel, and 22 lbs. air/1 lb. fuel).

The desired fuel charge ($f_d$) corresponding to $a/f_d$ is calculated by multiplying $(a/f_d)^{-1}$ by MAF in calculation block 48. Desired fuel charge $f_d$ is converted by respective look-up tables 51, 52, 53 and 54 into four separate fuel command signals $pw_1$, $pw_2$, $pw_3$ and $pw_4$ for actuating respective fuel injectors 18, 20, 22 and 24. Each fuel injector delivers fuel in proportion to the pulse width of fuel command signals $pw_1$, $pw_2$, $pw_3$ and $pw_4$. In this example, each look-up table comprises a map of the appropriate pulse width (pw) versus $f_d$ contained in a random access memory. The map is an assumed fuel injector response of a fuel injector to the pulse width of a fuel command. Initially, each of the look-up tables 51, 52, 53 and 54 contains the same map which assumes that the response of all fuel injectors to the same pulse width is substantially the same and remains so over time.

The feedback loop for maintaining the engine's average air/fuel ratio near the desired air/fuel ratio $a/f_d$ is now described. An air/fuel ratio error ($a/f_e$) is determined by subtracting $a/f_a$ from a $a/f_d$ in error circuit 56. The air/fuel ratio error ($a/f_e$) is converted to a fuel error ($f_e$) by multiplying MAF x $(a/f_e)^{-1}$ in multiplier circuit 58. Fuel error ($f_e$) is converted to pulse width error ($pw_e$) by use of look-up table 62 which is similar to look-up tables 51, 52, 53 and 54. Each of the pulse width fuel command signals $pw_1$, $pw_2$, $pw_3$ and $pw_4$ is then added with pulse width error $pw_e$ via respective adder circuits 71, 72, 73 and 74. Thus, in response to a detected error in the average air/fuel ratios ($a/f_e$) among the combustion chambers, each of the fuel command signals $pw_1$, $pw_2$, $pw_3$ and $pw_4$ is simultaneously corrected by the same amount. It is noted that any variation in fuel delivered among the fuel injectors is not corrected. The average of the fuel delivered by all the fuel injectors is corrected by the feedback loop described hereinabove. There may be variations in fuel delivered and, accordingly, the air/fuel ratio among the combustion chambers. These variations among the fuel injectors are substantially eliminated by the correction loop which is now described.

The correction loop for correcting variations in actual fuel delivered among the fuel injectors is initiated for a predetermined correction period by detection block 78 provided that engine operating conditions are constant during the correction period. Detection block 78 monitors engine operating conditions such as, for example, engine revolutions (rpm), throttle angle (TA), and manifold pressure (MAP). When detection block 78 determines that engine operating conditions are relatively constant, the correction period is initiated by signal CP. During the correction period, corrections by $pw_e$ to fuel command signals $pw_1$, $pw_2$, $pw_3$ and $pw_4$ are disabled via select block 80 in response to signal CP. Concurrently, as described in greater detail hereinafter, fuel command signals $pw_1$, $pw_2$, $pw_3$ and $pw_4$ are offset by offset matrix 82 via select block 84. If engine operating conditions change during the correction period, select block 80 reverts back to $pw_e$ corrections in response to signal CP.

During the correction period, as described in greater detail below, the actual fuel delivered by each injector ($f_{a1}$, $f_{a2}$, $f_{a3}$ and $f_{a4}$) to each respective combustion chamber (1, 2, 3 and 4) are calculated in calculation block 86.

With the actual fuel delivered calculated, variations in fuel delivered and, accordingly, variations in air/fuel ratios among the combustion chambers are eliminated by correcting look-up tables 51, 52, 53 and 54.

In general, the actual fuel delivered is calculated by solving n-equations for n-unknowns (fuel delivered) where n is equal to the number of combustion chambers. Each of the n-equations represents combustion chamber conditions during a correction interval of the correction time period. During each correction interval, the actual fuel delivered by a preselected number of injectors is offset, rich or lean, by a predetermined amount. This predetermined offset for each injector is stored in a coefficient table represented as offset matrix 82. For each correction interval, the average of air/fuel ratios among the combustion chambers is measured. The product of air/fuel ratio measurement times MAF equals the sum of the actual fuel delivered (unknowns) by each injector times the appropriate offset multiplier for the appropriate injector. This procedure is repeated for n correction intervals, four in this example, until n-equations and n-unknowns are generated. The actual fuel delivered by each injector is then calculated in calculation block 86.

For illustrative purposes, an example of a correction loop is presented for the four cylinder engine shown in FIG. 1 utilizing one of many possible sets of offset multiplier matrixes. During the first correction interval (I) of the correction period, the fuel actually delivered by fuel injector 20 to combustion chamber 2 ($f_{a2}$) is offset 20% in the rich direction; and, the fuel actually delivered by fuel injector 24 to combustion chamber 4 ($f_{a4}$) is offset 20% in the lean direction. The average of the air/fuel ratios among the combustion chambers ($a/f_{aI}$) is measured for the first correction interval. The following equation is generated by calculator block 86 for the first correction interval of the correction period:

$$f_{a1} + 1.2 f_{a2} + f_{a3} + .8 f_{a4} = MAF \times (a/f_{aI})^{-1}$$

During the second correction interval (II) of the correction period, the fuel actually delivered by fuel injector 20 to combustion chamber 2 ($f_{a2}$) is offset 20% in the lean direction; and, the fuel actually delivered by fuel injector 22 to combustion chamber 3 ($f_{a3}$) is offset 20% in the rich direction. The corresponding average of the air/fuel ratios among the combustion chambers ($a/f_{aII}$) is measured for the second correction interval. Accordingly, the following equation is generated during the second correction interval of the correction period:

$$f_{a1} + .8 f_{a2} + 1.2 f_{a3} + f_{a4} = MAF \times (a/f_{aII})^{-1}$$

During the third correction interval (III) of the correction period, the fuel actually delivered by fuel injector 18 to combustion chamber 1 ($f_{a1}$) is offset 20% in the rich direction; and, the fuel actually delivered by fuel injector 22 to combustion chamber 3 ($f_{a3}$) is offset 20% in the lean direction. The corresponding average of the air/fuel ratios among the combustion chambers ($a/f_{aIII}$) is measured for the third cycle. The following equation is generated during the third correction interval of the correction period:

$$1.2 f_{a1} + f_{a2} + .8 f_{a3} + f_{a4} = MAF + (a/f_{aIII})^{-1}$$

During the fourth correction interval (IV) of the correction period, the fuel actually delivered by fuel injector 18 to combustion chamber 1 ($f_{a1}$) is offset 20% in the lean direction; and, the fuel actually delivered by fuel injector 24 to combustion chamber 4 ($f_{a4}$) is offset 20% in the rich direction. The corresponding average of the air/fuel ratios among the combustion chambers ($a/f_{aIV}$) is measured for the fourth cycle. Accordingly, the following equation is generated during the fourth correction interval of the correction period:

$$.8 f_{a1} + f_{a2} + f_{a3} + 1.2 f_{a4} = MAF \times (a/f_{aIV})^{-1}$$

These equations are presented in matrix form as follows:

$$\begin{bmatrix} 1 & 1.2 & 1 & .8 \\ 1 & .8 & 1.2 & 1 \\ 1.2 & 1 & .8 & 1 \\ .8 & 1 & 1 & 1.2 \end{bmatrix} \begin{bmatrix} f_{a1} \\ f_{a2} \\ f_{a3} \\ f_{a4} \end{bmatrix} = \begin{bmatrix} a/f_{aI}^{-1} \\ a/f_{aII}^{-1} \\ a/f_{aIII}^{-1} \\ a/f_{aIV}^{-1} \end{bmatrix}$$

Accordingly:

$$\begin{bmatrix} f_{a1} \\ f_{a2} \\ f_{a3} \\ f_{a4} \end{bmatrix} = \begin{bmatrix} 1 & 1.2 & 1 & .8 \\ 1 & .8 & 1.2 & 1 \\ 1.2 & 1 & .8 & 1 \\ .8 & 1 & 1 & 1.2 \end{bmatrix} \begin{bmatrix} a/f_{aI}^{-1} \\ a/f_{aII}^{-1} \\ a/f_{aIII}^{-1} \\ a/f_{aIV}^{-1} \end{bmatrix}$$

For this particular example:

$$\begin{bmatrix} \text{OFFSET} \\ \text{MATRIX} \end{bmatrix} = \begin{bmatrix} 1 & 1.2 & 1 & .8 \\ 1 & .8 & 1.2 & 1 \\ 1.2 & 1 & .8 & 1 \\ .8 & 1 & 1 & 1.2 \end{bmatrix}$$

Accordingly, with four equations and four unknowns, the actual fuel delivered ($f_{a1}$, $f_{a2}$, $f_{a3}$ and $f_{a4}$) by each injector to each respective combustion chamber is calculated. With actual fuel delivered calculated, respective look-up tables 51, 52, 53 and 54 are updated such that variations in actual fuel delivered among the injectors is substantially eliminated. Stated another way, look-up tables 51, 52, 53 and 54 are updated such that fuel command signals $pw_1$, $pw_2$, $pw_3$ and $pw_4$ are adjusted in pulse width for appropriately actuating respective fuel injectors 18, 20, 22 and 24 to deliver substantially the same fuel. In one embodiment used to advantage, individual values of fuel versus pw (at different locations within the table) are fitted by conventional regression techniques to the original values of pw versus fd. Those skilled in the art will recognize, however, that there are numerous other curve correcting techniques which may be used to advantage.

During any subsequent correction period, look-up tables 51, 52, 53, and 54 will again be updated as described hereinabove. The offset of numerous updates over subsequent correction periods will substantially cancel random errors. When the correction period is not actuated, select block 80 enables $pw_e$ to correct fuel command signals $pw_1$, $pw_2$, $pw_3$ and $pw_4$ in response to feedback of $a/f_a$ as described hereinabove. With variations in the air/fuel ratios among the combustion chambers substantially reduced as a result of the correction period, each combustion chamber will be maintained at substantially the desired air/fuel ratio ($a/f_d$) through feedback correction by $a/f_a$.

Referring back to the correction period, it is noted that an advantage of the calculation described herein is that simple linear algebra is utilized thereby avoiding the computational complexity of prior approaches. Another advantage is that by utilizing a measurement of average air/fuel ratio ($a/f_a$) over an entire correction interval, the requirements of prior approaches are eliminated wherein very fast exhaust gas oxygen sensors were used to calculate individual air/fuel ratios of each combustion chamber. Further, by averaging air/fuel ratios over an entire correction interval, superior signal to noise performance is achieved and the need for complex signal processing techniques associated with low signal to noise is eliminated. It is to be further noted that by offsetting one fuel injector in the rich direction and another fuel injector in the lean direction during each correction interval of the correction period, minimal driveability disturbance and perturbation in emissions is introduced. Further, a better curve fitting regression is obtainable.

It is noted that in the above description, a single MAF measurement was utilized during the correction period. This MAF measurement is an average of mass airflow during the entire correction period. However, a separate MAF measurement during each correction interval of the correction period may also be used to advantage. It is further noted that it is not necessary to use an MAF measurement at all to determine variations in air/fuel ratios among the combustion chambers. A constant may be substituted for MAF. In this case, the n-unknowns to be solved for are the fuel/air ratios among each combustion chamber as shown below:

$$\begin{bmatrix} f/a_1 \\ f/a_2 \\ f/a_3 \\ f/a_4 \end{bmatrix} = \begin{bmatrix} \text{OFFSET} \\ \text{MATRIX} \end{bmatrix}^K \begin{bmatrix} a/f_{aI}^{-1} \\ a/f_{aII}^{-1} \\ a/f_{aIII}^{-1} \\ a/f_{aIV}^{-1} \end{bmatrix}$$

Those skilled in the art will recognize that the teaching of the invention described herein may be applied to numerous control systems other than the single example presented herein. For example, most any offset matrix will suffice, provided the equations generated are not related to one another such that they may not be solved simultaneously. In general, the calculation for actual fuel charge delivered for each of n fuel injectors may be expressed in Matrix form as follows:

$$[f_{ai}] = [o_{ij}]\, MAF\, [a/f_{ai}^{-1}]$$

where: $f_{ai}$ represents the actual fuel charge delivered by each of n fuel injectors ($i = j = 1$ to n); $o_{ij}$ represents an offset coefficient for each fuel injector during each of n correction intervals; MAF represents the measurement of mass airflow during the entire correction period; and $a/f_{ai}$ represents the measurement of average air/fuel ratios among the combustion chambers for each of n correction intervals. It will also be recognized that more sophisticated fuel injector transfer functions (pw versus $f_d$) may be utilized and updated. In addition, the invention is not limited to a proportional exhaust gas oxygen sensor. A "two-state" type exhaust gas oxygen sensor may be utilized by ramping the injectors to switch the sensor, and then averaging the sensor states to obtain an average air/fuel ratio.

This concludes the description of the preferred embodiment. The reading of it by those skilled in the art will bring to mind many alterations and modifications without departing from the spirit and scope of the invention. Accordingly, it is intended that the scope of the invention be limited only by the following claims.

What is claimed is:

1. A fuel injection control method for correcting variations in fuel delivered among a plurality of fuel injectors each being coupled to an engine combustion chamber, said fuel injection control method comprising the steps of:
   - generating a separate fuel command signal for each of the fuel injectors such that fuel delivered by each of the injectors is proportional to said fuel command signal coupled to the respective fuel injector;
   - offsetting each of said fuel command signals in a predetermined sequence during a correction time period;
   - providing a measurement of average air/fuel ratio among the combustion chambers during said correction period;
   - calculating the variation in fuel charges actually delivered among the fuel injectors during said correction time period in response to the amount of said offset and said measurement of air/fuel ratio; and
   - correcting said fuel command signals in response to said calculation such that each of the fuel injectors delivers substantially the same amount of fuel in response to said fuel command signal.

2. A fuel injection control method for correcting variations in fuel delivered among a plurality of fuel injectors each being coupled to an engine combustion chamber, said fuel injection control method comprising the steps of:
   - generating a separate fuel command signal for each of the fuel injectors such that fuel delivered by each of the injectors is proportional to said fuel command signal coupled to the respective fuel injector;
   - offsetting each of said fuel command signals in a predetermined sequence during a correction time period;
   - measuring airflow inducted into the combustion chambers during said correction time period;
   - providing a measurement of average air/fuel ratio among the combustion chambers during said correction period;
   - calculating the actual fuel charge delivered by each of the fuel injectors during said correction time period in response to the amount of said offset and said measurement of air/fuel ratio and said measurement of inducted airflow; and
   - correcting said fuel command signals in response to said calculation of actual fuel charge such that each of the fuel injectors delivers substantially the same amount of fuel in response to said fuel command signal.

3. A fuel injection control system coupled to a multiport fuel injected engine for adjusting the air/fuel mixture of each combustion chamber to a preselected level, said fuel injection control system comprising:

a plurality of fuel injectors, each responsive to a separate fuel command signal and each coupled to one of the combustion chambers;

airflow means providing an airflow signal related to airflow inducted into the engine;

signal generating means responsive to said airflow signal for generating said plurality of fuel command signals;

offset means for individually offsetting each of said fuel command signals in a predetermined sequence by a predetermined amount during a correction time period;

an air/fuel sensor providing and air/fuel ratio signal indicative of an average air/fuel ratio among the combustion chambers;

calculation means responsive to said offset means and said air/fuel ratio signal and said airflow signal for calculating the actual fuel charge delivered by each of said fuel injectors during said correction time period; and update means responsive to said calculating means for updating said signal generating means during said correction time period to maintain the preselected air/fuel ratio in each of the combustion chambers.

4. The fuel injection control system recited in claim 3 wherein said correction time period comprises a number of correction intervals equal to the number of combustion chambers.

5. The fuel injection control system recited in claim 4 wherein said calculating means multiplies said airflow signal times an inverse of said air/fuel ratio signal during each of said correction intervals.

6. The fuel injection control system recited in claim 5 wherein said offset means offsets a different pair of the fuel injectors during each of said correction intervals.

7. The fuel injection control system recited in claim 6 wherein said offset means offsets one of said pair of fuel injectors in a rich direction and the other of said pair of fuel injectors in the lean direction.

8. A fuel injection control system coupled to a multiport fuel injected engine for adjusting the air/fuel mixture of each combustion chamber to a preselected level, said fuel injection control system comprising:

a plurality of fuel injectors, each responsive to a separate fuel command signal and each coupled to one of the combustion chambers;

airflow means providing an airflow signal related to airflow inducted into the engine;

conversion means responsive to said airflow signal for providing a base fuel signal proportional to a desired air/fuel mixture;

fuel command means responsive to said base fuel signal for providing said plurality of fuel command signals, said fuel command means including a plurality of look-up tables, each responsive to said base fuel signal for providing one of said fuel command signals;

means for perturbing each of said fuel command signals in a predetermined sequence by a predetermined amount during a correction time period;

an air/fuel sensor providing an air/fuel ratio signal indicative of an average air/fuel ratio among the combustion chambers;

calculation means responsive to said perturbation means and said air/fuel ratio signal and said airflow signal for calculating the actual fuel charge delivered by each of said fuel injectors during said correction time period; and updating means coupled to said calculating means for updating each of said look-up tables during said correction time period to maintain the preselected air/fuel ratio in each of the combustion chambers.

9. The fuel injection control system recited in claim 8 further comprising:

a source of a desired air/fuel ratio;

fuel error means responsive to said desired air/fuel ratio and said airflow signal and said air/fuel ratio signal for calculating an overall fuel error among the combustion chambers; and means responsive to said fuel error means for altering each of said fuel command signals by an equal amount to maintain a desired average air/fuel ratio among the combustion chambers.

10. The fuel injection control system recited in claim 9 wherein said correction time period comprises a number of correction intervals equal to the number of combustion chambers.

11. The fuel injection control system recited in claim 10 wherein said calculating means multiplies said airflow signal times an inverse of said air/fuel ratio signal during each of said correction intervals.

12. The fuel injection control system recited in claim 11 wherein said perturbation means perturbs a different pair of the fuel injectors during each of said correction intervals.

13. The fuel injection control system recited in claim 12 wherein said perturbation means perturbs one of said pair of fuel injectors in a rich direction and the other of said pair of fuel injectors in the lean direction.

* * * * *